US009039546B2

(12) United States Patent
Dawson et al.

(10) Patent No.: US 9,039,546 B2
(45) Date of Patent: May 26, 2015

(54) IMPACT TRAINING DEVICE

(71) Applicant: Davinci Sports International, Inc., Fort Lauderdale, FL (US)

(72) Inventors: Dale A Dawson, Davie, FL (US); Warren Bottke, Palm Beach Gardens, FL (US)

(73) Assignee: Davinci Sports International, Inc., Sunrise, FL (US)

( * ) Notice: Subject to any disclaimer, the term of this patent is extended or adjusted under 35 U.S.C. 154(b) by 0 days.

(21) Appl. No.: 13/959,396

(22) Filed: Aug. 5, 2013

(65) Prior Publication Data

US 2014/0045625 A1 Feb. 13, 2014

Related U.S. Application Data

(60) Provisional application No. 61/680,540, filed on Aug. 7, 2012.

(51) Int. Cl.

| | |
|---|---|
| ***A63B 69/36*** | (2006.01) |
| ***A63B 69/00*** | (2006.01) |
| *A63B 71/06* | (2006.01) |

(52) U.S. Cl.

CPC ..... *A63B 69/3641* (2013.01); *A63B 69/00* (2013.01); *A63B 69/0057* (2013.01); *A63B 2071/0694* (2013.01); *A63B 2210/50* (2013.01); *A63B 2220/20* (2013.01); *A63B 2225/09* (2013.01); *A63B 2225/093* (2013.01)

(58) Field of Classification Search

USPC ..... 473/201, 203, 206, 207, 212, 223, 226, 473/227, 231, 266, 276, 422

See application file for complete search history.

(56) References Cited

U.S. PATENT DOCUMENTS

| | | | | |
|---|---|---|---|---|
| 5,009,426 | A | 4/1991 | Cox | |
| 5,470,073 | A * | 11/1995 | Vasquez | 473/206 |
| 5,904,624 | A * | 5/1999 | Martinez | 473/212 |
| 7,033,282 | B1 * | 4/2006 | Flood | 473/227 |
| 7,914,388 | B2 * | 3/2011 | Cox | 473/212 |
| 8,128,507 | B1 * | 3/2012 | Chuck | 473/276 |
| 8,663,024 | B2 | 3/2014 | Kardos | |

* cited by examiner

*Primary Examiner* — Nini Legesse

(74) *Attorney, Agent, or Firm* — Christopher & Weisbegr, P.A.

(57) ABSTRACT

An impact training device for a sports device. The training device includes an elongate rod, a handle engagement element and a handle connector joining the handle engagement element to the elongate rod. The elongate rod is radially displaced from a handle of the sports device when the handle engagement element is engaged to the handle of the sports device.

19 Claims, 8 Drawing Sheets

IMPACT TRAINING DEVICE

CROSS-REFERENCE TO RELATED APPLICATION

This application is related to and claims priority to U.S. Provisional Patent Application Ser. No. 61/680,540, filed Aug. 7, 2012, entitled SPORTS TRAINING DEVICE AND SYSTEM, the entirety of which is incorporated herein by reference.

STATEMENT REGARDING FEDERALLY SPONSORED RESEARCH OR DEVELOPMENT n/a

FIELD OF THE INVENTION

The present invention relates to sports training devices, and in particular, an impact training device and method of use thereof.

BACKGROUND OF THE INVENTION

A proper swing in contact sports, in which the object is to contact a ball, is paramount for success. A proper golf swing, however, is not simple—many different muscles and forces are involved that depend on biomechanics and physics to achieve a desired swing. However, no one athlete has the same body type, and different athletes have different relative strengths and weakness that contribute to a particular motion during a golf swing. Certain aspects of a proper golf swing require certain body movements and club orientations to achieve the proper swing. For example, in a golf swing it is important to the golfer's wrists and forearms in proper alignment during the backswing, downswing, and follow-through. To improve on these aspects of a proper swing, building muscle memory and/or motor skills through repetition of a proper swing is important.

Current sports training devices designed to affect an athlete's swing, however, focus on a single aspect of the swing rather than the entire range of motion. For example, current devices may target one muscle or one specific movement among the many muscles and movements involved in a swing. Thus, current devices may over train certain muscles and under train others, and thus are not particularly effective at training the athlete at the particular aspects of a proper swing based on the athlete's own body mechanics. Similarly, in other sports such as baseball, tennis, and hockey, there are a lack of devices that train the user to use the proper muscles during the entire swing.

SUMMARY OF THE INVENTION

The present invention advantageously provides an impact training device. The device includes an elongate rod. A handle engagement element is included. A handle connector joining the handle engagement element to the elongate rod. The elongate rod being radially displaced from a handle of a sports device when the handle engagement element is engaged to the handle of the sports device In another configuration of the device, the device includes a first elongate rod. A handle engagement element is included. A handle connector joining the handle engagement element to the elongate rod is included. The first elongate rod is radially displaced from a handle of a sports device when the handle engagement element is engaged to the handle of the sports device. A second elongate rod engageable with the handle connector is included, the second elongate rod being substantially orthogonal to the handle connector when engaged to the first elongate rod. A first alignment element movably engaged to the second elongate rod is included.

In yet another configuration of the device, the device includes an elongate rod including a sports device engagement element. A handle engagement element is included. A handle connector joining the handle engagement element to the elongate rod is included. The elongate rod is radially displaced from a handle of a sports device when the handle engagement element is engaged to the handle of the sports device. The elongate rod, the handle connector, the handle engagement element, and the sports device engagement element define a closed loop with the handle of sports device when the handle engagement element is engaged to the handle of the sports device and the sports device engagement element is engaged to the sports device. A first alignment element movably affixed to the handle connector is included. A second alignment element movably affixed to the elongate rod is included. A wrist guide element movable affixable to the elongate rod is included.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
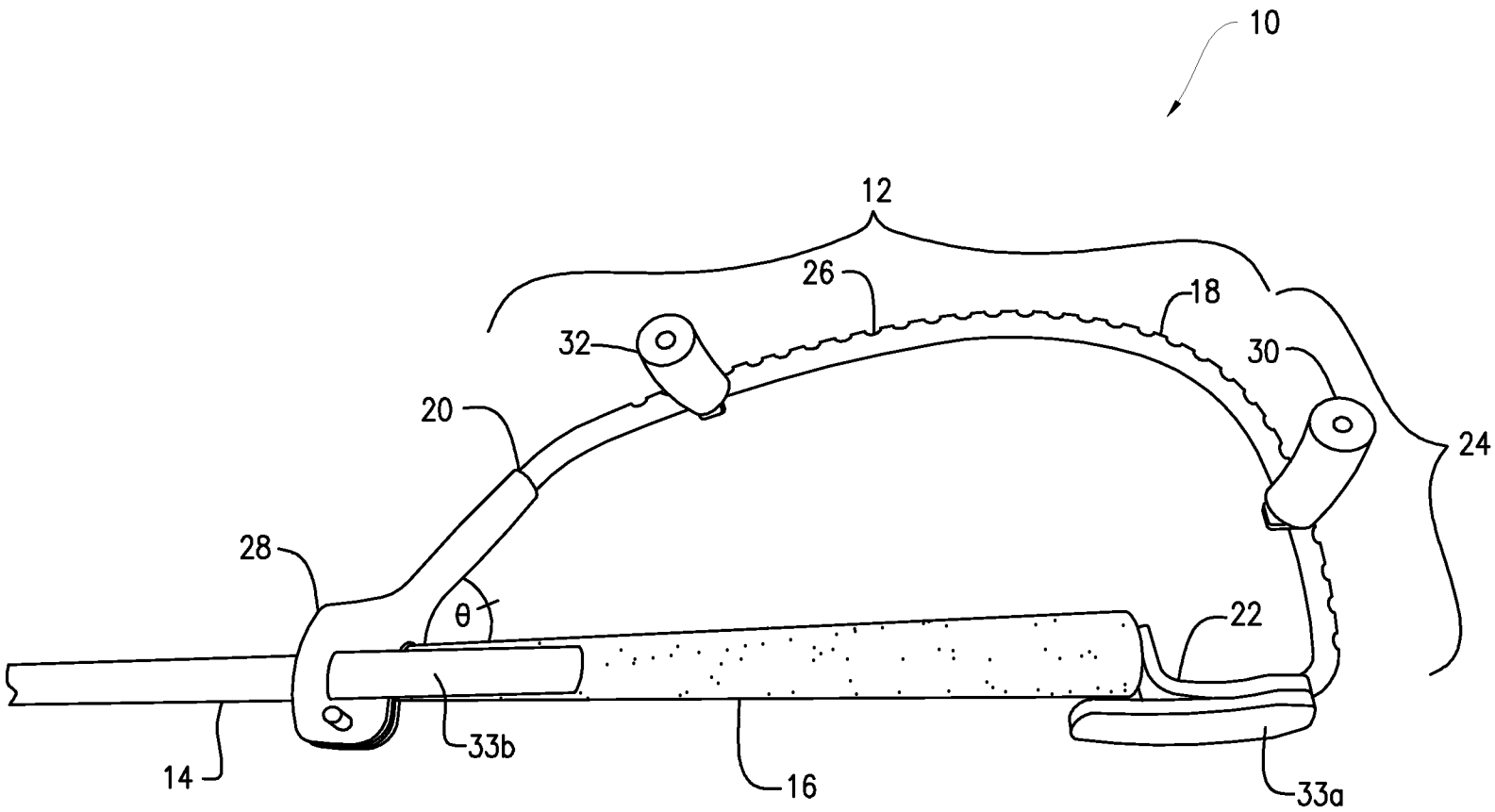
FIG. 1 is a side perspective view of an impact training device attached to a sports device and generally constructed in accordance with the principles of the present invention.

Now referring to the drawings in which like reference designators refer to like elements, there is shown in the drawings an impact training device constructed in accordance with the principles of the present invention and designated generally as "10." The device 10 is engageable with a sports device 14. As used herein, the term sports device includes, but is not limited to, golf clubs, baseball bats, hockey sticks, lacrosse sticks, tennis racquets, or any sports equipment having a handle 16 to which the user may grip, and in which the user operates to make contact with a ball, puck, and the like. A first elongate rod 12 may be composed of a rigid material, for example, aluminum, steel, other metals or composites, or plastics. The first elongate rod 12 may include a first end 18 and second end 20 and may be substantially cylindrical in shape and may define a solid or hollow interior. In other embodiments, the first elongate rod 12 may define any shape, for example, rectangular. In an exemplary configuration, the diameter of the first elongate rod 12 may be approximately one-half inch, but may vary depending on the particular sports device 14 the first elongate rod 12 is used with. For example, in the configuration shown in FIG. 1, the first elongate rod 12 defines a width less than the width of the handle 16 of the exemplary golf club 14.

A handle engagement element 22 is coupled to a handle connector 24, as discussed in more detail below, and engages the handle 16 of the sports device 14. The handle engagement element 22 may be a clamp or other connector operable to releaseably connect the handle connector 24 to the handle 16. In other configurations, the handle engagement element 22 may be a bolt or peg that may be permanently affixable to the distal end of the handle 16. For example, the handle engagement element 22 may engage an end portion of the handle 16, for example, the butt end of a golf club, or alternatively may engage any portion of the handle 16. In an exemplary configuration, the handle 16 of the sports device 14 defines a major axis along its length. The handle engagement element 22 may also define a major axis along its length and the major axis of the handle engagement element 22 is substantially parallel to the major axis of sports device 14 when the handle engagement element 22 is engaged to the handle 16.

Continuing to refer to FIG. 1, when the handle engagement element 22 is engaged to the handle 16, or any portion of the sports device 14 thereof, the first elongate rod 12 is separated from the sports device 14, i.e., is radially displaced a distance away from the handle 16 and/or the sports device 14. For example, the first elongate rod 12 may define a curved structure that extends a radial distance away from the handle 16 and/or sports device 14 when the handle engagement element 22 is engaged to the handle 16 and/or sports device 14. The curvature of the first elongate rod 12 may be substantially arcuate in shape, such that when the handle engagement element 22 is coupled to the end of the handle 16, the second end 20 of the elongate rod may be proximate or in contact with another portion of the handle 16.

The first elongate rod 12 may define, or otherwise include, the handle connector 24 extending from the first end 18 in a direction substantially orthogonal to the major axis of the sports device 14. The handle connector 24 may be substantially linear or curvilinear in shape and may extend a predetermined distance away from the handle 16 when the handle engagement element 22 is engaged to the handle 16. For example, the handle connector 24 may be between 2-6 inches in length and joins the handle engagement element 22 to the first elongate rod 12. The handle connector 24 may be a contiguous portion of the first elongate rod 12 or alternatively may be removeably securable to the first elongate rod 12. Additionally, the handle connector 24 may be contiguous or removeably securable to the handle engagement element 22.

A sports device engagement element 28 may be included at the second end 20 of the first elongate rod 12. The sports device engagement element 20 may be included or otherwise molded to the second end 20, or at any position along the length of the first elongate rod 12 and may be configured to removeably engage the first elongate rod 12 to the handle 16 or any portion of the sports device 14. In an exemplary configuration, the sports device engagement element 20 may be a clamp sized to releaseably engage the sports device 14. For example, as shown in FIG. 1, the handle engagement element 22 engages a portion of the sports device 14 at the end of the handle 16 and the second engagement element 28 engages the opposite end of the handle 16. The sports device engagement element 28 may further define an acute angle with the handle 16 of the sports device 14 when engaged to the handle 16. For example, the sports device engagement element 28 may define an angle "A" less than or equal to 90 degrees when engaged to the handle 16. In such a configuration, the first elongate rod 12, the handle engagement element 22, the handle connector 24, and the sports device engagement element 28 define a closed loop with the handle 16 of the sports device 14.

Continuing to refer to FIG. 1, a first alignment element 30 may be movably engageable to the first elongate rod 12 or the handle connector 24 at a plurality of positions along the length of the first elongate rod 12 or the handle connector 24. The first alignment element 30 may be a post or other structure than extends from the first elongate rod 12 or the handle connector. In an exemplary configuration, the first alignment element 30 is a substantially linear post orthogonally engaged to the handle connector 24. The first alignment element 30 is operable to apply pressure to the user's wrist when the user swings the sports device 14 to maintain the proper position of the user's wrist relative to the handle 16. A second alignment element 32 may be movably engageable to the first elongate rod 12 at a plurality of positions along the length of the first elongate rod 12. The second alignment element 32 may be identical in structure to the first alignment element 30 and is further operable to apply a force to a user's other wrist when a user swings the sports device 14. In an exemplary configuration, the second alignment element 32 is movably coupled to the first elongate rod 12. It is further contemplated that any number of alignment elements may be movably or permanently affixedly coupled to the first elongate rod 12. For example, the alignment elements may be movably securable to a plurality of notches disposed on the first elongate rod 12 and the handle connector 24.

Continuing to refer to FIG. 1, pressure pads 33*a* and 33*b* may be removeably or permanently affixed to the handle engagement element 22 and the sports device engagement element 28, respectively. The pressure pads 33*a* and 33*b* may be adhesively attached to their respective engagement elements and may be composed of a shock absorbing and compressible material such as foam such that the user applies the proper pressure to handle 16 during a swing. In an exemplary configuration, the pressure pad 33*a* is releasably adhered to the exterior surface of the handle engagement element 28 and the pressure pad 33*b* is releasably adhered to the exterior portion of the device engaged element 28 and extends upward along a portion of the handle 16. In an exemplary use of the pressure pads 33*a* and 33*b*, the user may press three fingers on his lead hand on the pressure pad 33*a* and the index finger of his trail hand on the pressure pad 33*b* and maintains these grip positions during the duration of the swing.

Figure 2:
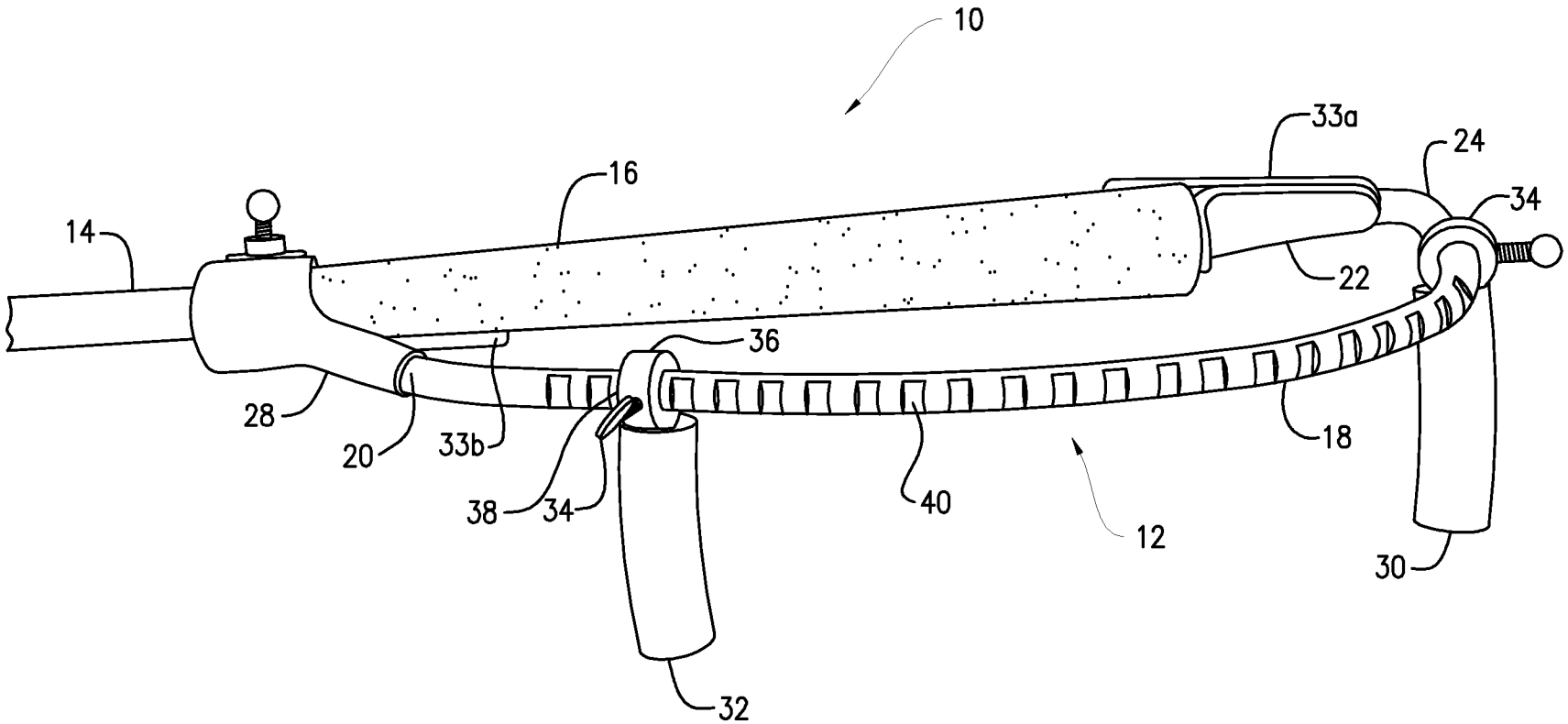
FIG. 2 is a front perspective view of the impact training device shown in FIG. 1.

Referring now to FIG. 2, the first alignment element 30 and the second alignment element 32 may each include a fastening element 34 operable to releaseably engage each alignment element to the first elongate rod 12 or the handle connector 24, respectively. The fastening element 34 may include a loop 36 sized to be circumferentially disposed about the first elongate rod 12. The loop 36 may be metallic and substantially toroidal in shape such that the inner diameter of the loop 36 is larger than the diameter of the first elongate rod 12. The loop 36 allows the fastening element 34, and thereby the first alignment element 30, to rotate about the first elongate rod 12 or the handle connector 24 to a desired position. In an exemplary configuration, the fasting element 34 may rotate 360 degrees about the first elongate rod 12. A release pin or screw 38 may be coupled to the fastening element 34 and is operable to tighten or release the loop 36 to the first elongate rod 12 or the handle connector 24. For example, the pin 38 may extend into and retract from the interior of the loop 38 and contact the surface of the first elongate rod 12. As the pin 38 is rotated in a first direction it contacts the first elongate rod 12 or the handle connector 24 to secure the first alignment element 30 to the elongate rod 12, and when the pin is rotated in a second direction different than the first direction, the pin 38 allows the loop 36 to both rotate and slide about the first elongate rod 12 or the handle connector 24. In an exemplary particular configuration, the pin 38 may release from the fastening element 34 when a predetermined amount of pressure is applied to the first alignment element 30 or the second alignment element 32. That is, should the user apply pressure than the maximum allowable pressure to the first alignment element 30 or the second alignment element 32, the pin 38 may release from the fastening element 34, which unlocks the loop 36 from the first elongate rod 12 or the handle connector 24, which in turn may alert the user that too much force is being applied to the first alignment element 30 or the second alignment element 32.

To facilitate the movement of the loop 36 about the first elongate rod 12 or the handle connector 24, the first elongate rod 12 and/or the handle connector 24 may include a plurality of notches 40 along its length. The notches 40 may be spaced a predetermined distance away from an adjacent notch 40 or may be asymmetrically spaced along the length of the first elongate rod 12 and/or the handle connector 24. The notches 40 may define a predefined depth sized to receive a portion of the loop 36. The loop 36 and thereby the first alignment element 30 may be moved longitudinally along the length of the first elongate rod 12 and/or the handle connector 24 to a desired notch 40. When a portion of the loop 36 is received within a desired notch 40, a portion of the loop 36 contacts the walls of the first elongate rod 12 or the handle connector 24 that defines notch 40, such that the loop 40 is at least partially restricted lateral movement within the notch 40. When the desired radial position of the loop 36 is achieved within the notch 40, the pin 38 may secure the loop 38 within a respective to notch 40, which prevents rotational movement of the loop 36 within the notch 40, and further operates to affix the first alignment element 30 and/or the second alignment element 32 to the first elongate rod 12 at a desire longitudinal distance along the length of the first elongate rod 12 and/or the handle connector 24 and a desired radially location about the first elongate rod 12 or the handle connector 24.

Figure 3:
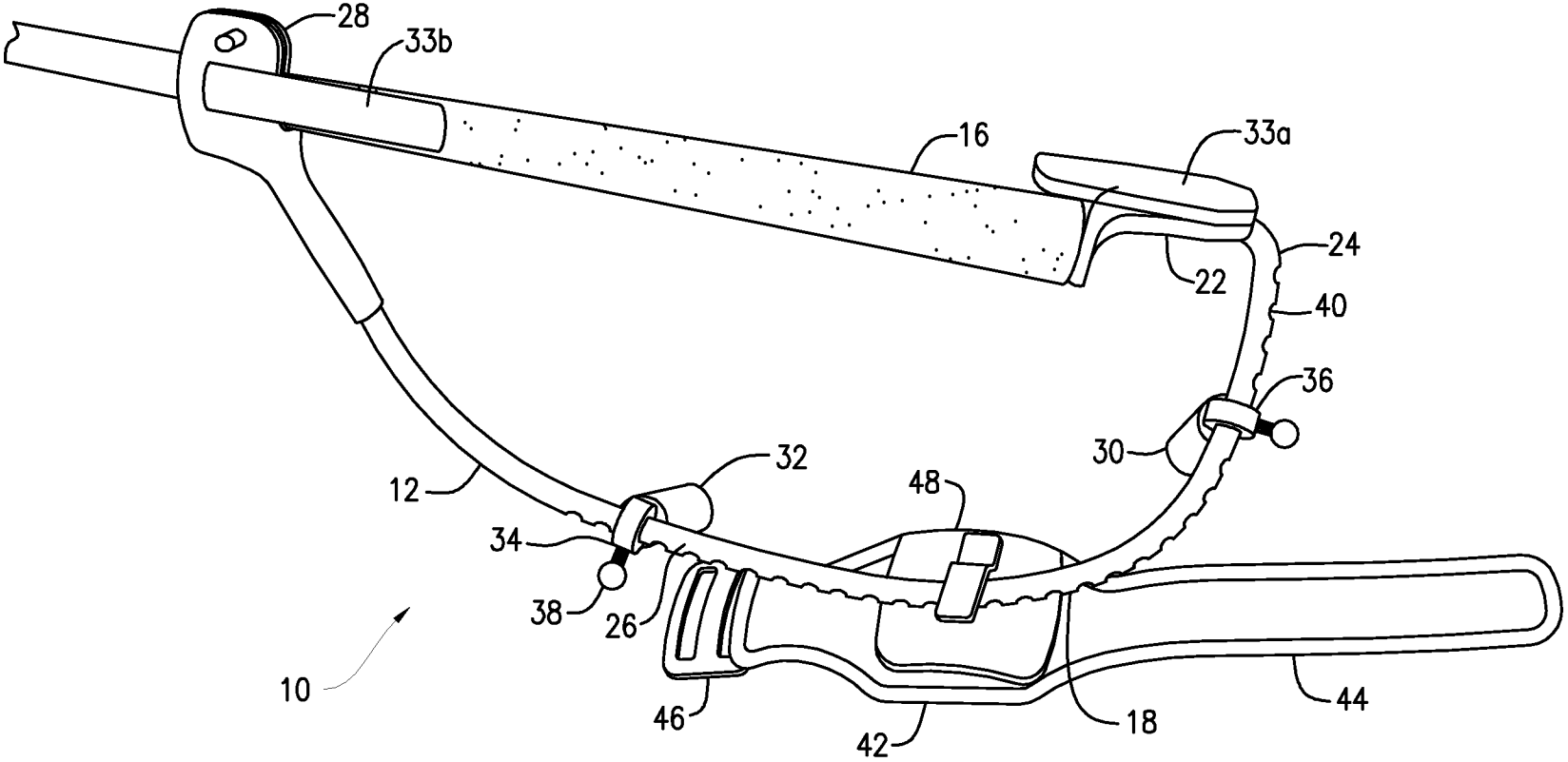
FIG. 3 is a side perspective view of the impact training device shown in FIG. 1 with a wrist guide element.

Referring now to FIG. 3, a wrist guide element 42 may be included and disposed between the first alignment element 30 and the second alignment element 32 or along any portion of the first elongate rod 12 thereof. The wrist guide element 42 may include a strap 44 sized to wrap around a user's wrist. The strap 44 may include a fastener 46, such a buckle, hook and loop fastener, or other releasable attachment mechanisms known in the art. In a particular configuration, the wrist guide element 42 may be wrapped around the user's trail arm such that the user's trail arm wrist is in contact with the second alignment element 32 during a golf swing. The wrist guide element 42 may further include a latch 48 or other connection that releaseably or affixedly attaches the wrist guide element 42 within one or more of the notches 40. The latch 48 may include a removeably adjustable screw that when removed detaches a portion of the latch 38 from the wrist guide element 42 such that the first elongate rod 12 may be slid within a portion of the latch 48. When a portion of the first elongate rod 12 positioned within the latch 48, the screw may be inserted within the latch 48 to affix the wrist guide element 42 to the first elongate rod 12. The latch 48 may be included on the outer surface of the wrist guide element 42 such that when the wrist guide element 42 is attached to the first elongate rod 12, the user's trail wrist is disposed between the handle 16 and the first elongate rod 12.

Figure 4:
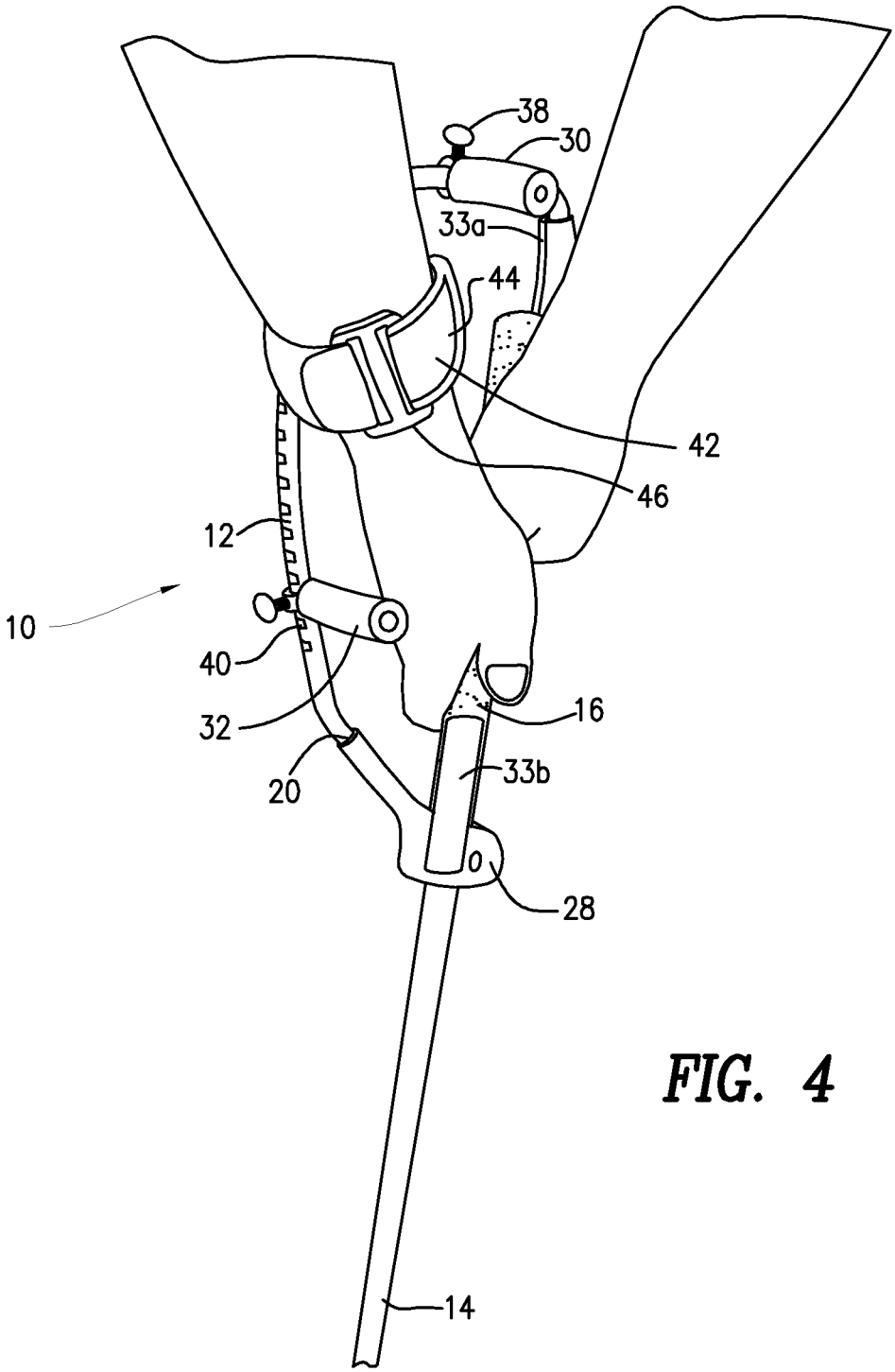
FIG. 4 is a front perspective view of the impact training device shown in FIG. 1 showing an exemplary use of the impact training device.

Referring now to FIG. 4, in an exemplary use of the training device 10 with a golf club 14, the user positions the first alignment element 30 and/or the second alignment element 32 and the wrist guide element 42 to a desired location along the first elongate rod 12 or the handle connector 24. For example, the second alignment element 32 may be positioned such that it as adjacent the outer portion of the wrist of the user's trail arm. The wrist guide element 42 may be attached to the first elongate rod 12 such that first alignment element 30 is disposed between the user's inner wrists when the user's grips the handle 16 with both arms. During a backswing of the user's outer wrist of the trail arm may contact the second alignment element 32 and prevent the wrist from over flexing. As the user directs the golf club into the downswing and into the follow through, the user's inner wrist on its trail arm may contact the first alignment element 30 to prevent the user's wrist from over-pronating. Accordingly, the device 10 operates to maintain the alignment of the wrists during the complete golf swing or any swing. The positions of the first alignment element 30, second alignment element 32, and the wrist guide element 42 may be adjusted depending on the particular sports device 14 and handle 16 the device is to be used with. For example, depending on the particular sports device 14, one or more of the first alignment element 30, the second alignment element 32, and the wrist guide element 42 may be used at various positions along the first elongate rod 12 to achieve the desired wrist angle position during a complete swing.

Figure 5:
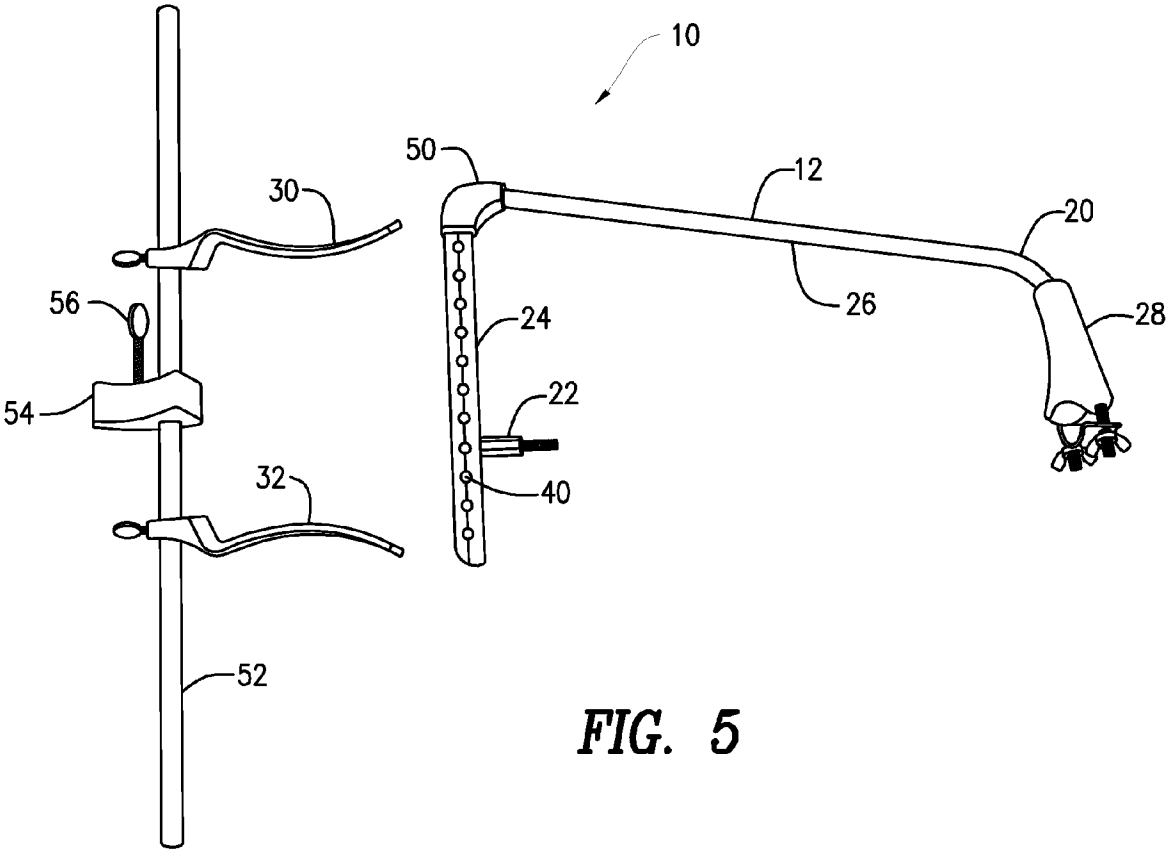
FIG. 5 is a disassembled view of another embodiment of an impact training device and generally constructed in accordance with the principles of the present invention.

Referring now to FIG. 5, in another configuration of the impact training device 10, the handle connector 24 is substantially linear in shape and the elongate rod 12 is also substantially linear in shape and extends at an acute angle form an elbow joint 50 defined by the first elongate rod 12. The handle engagement 22 may be a screw or other fastener configured to be affixedly or releasably engaged to the end of the handle 16. In the particular configuration shown in FIG. 5, the handle engagement element 22 may be drilled into the handle 16 of a golf club to secure the device 10 to the sports device 14. The sports device engagement 28 may include one or more screws or clamps to releasably engage another portion of the handle 16. The handle connector 24 may include the plurality of notches 40 along its length. In this configuration, the notches 40 are apertures defined along the length of the handle connector 24.

Continuing to refer to FIG. 5, the device 10 may include a second elongate rod 52 engageable with the handle connector 24. The second elongate rod 52 may be substantially cylindrical in shape, or any shape, and in a particular configuration, may have a similar diameter to that of the handle connector 24. The first alignment element 30 and the second alignment element 32 may be moveably engaged to the second elongate rod 52 by another fastening element 34. For example, each alignment element may include a fastening element 34, which may facilitate the longitudinal and circumferential movement of each alignment element along and about the handle connector 24. In the configuration shown in FIG. 5, the first alignment element 30 and the second alignment element 32 each define a curvature to contour the respective upper wrist and/or forearm to be pressed against each respective alignment element. For example, the first alignment element 30 and the second alignment element 32 may define substantially arcuate configurations to provide comfort for the user when using the sports device 14. In an exemplary configuration, the first alignment element 30 and the second alignment element 32 are oriented on the second elongate rod 52 to have opposite curvatures such that each defines an outwardly facing concavity to accommodate the user's wrist and/or forearm of each of the user's arms.

A second rod engagement element 54 may be coupled to the second elongate rod 52 operable to engage the second elongate rod 52 to the handle connector 24. The second rod engagement element 54 may be a latch or other connector operable to releaseably connect the second elongate rod 52 to the handle connector 24. As shown in FIG. 5, the second rod engagement element 54 may be positioned between the first alignment element 30 and the second alignment element 32. In other configurations, the second rod engagement element 54 may be positioned on either side of either the first alignment element 30 and/or the second alignment element 32. In an exemplary configuration, the second rod engagement element 54 includes a threaded screw or pin 56, similar to that of the fastening element 34. The screw 56 may be threaded or otherwise inserted within one or more notches 40 on the handle connector 24 to secure the second elongate rod 52 to the handle connector 24.

Figure 6:
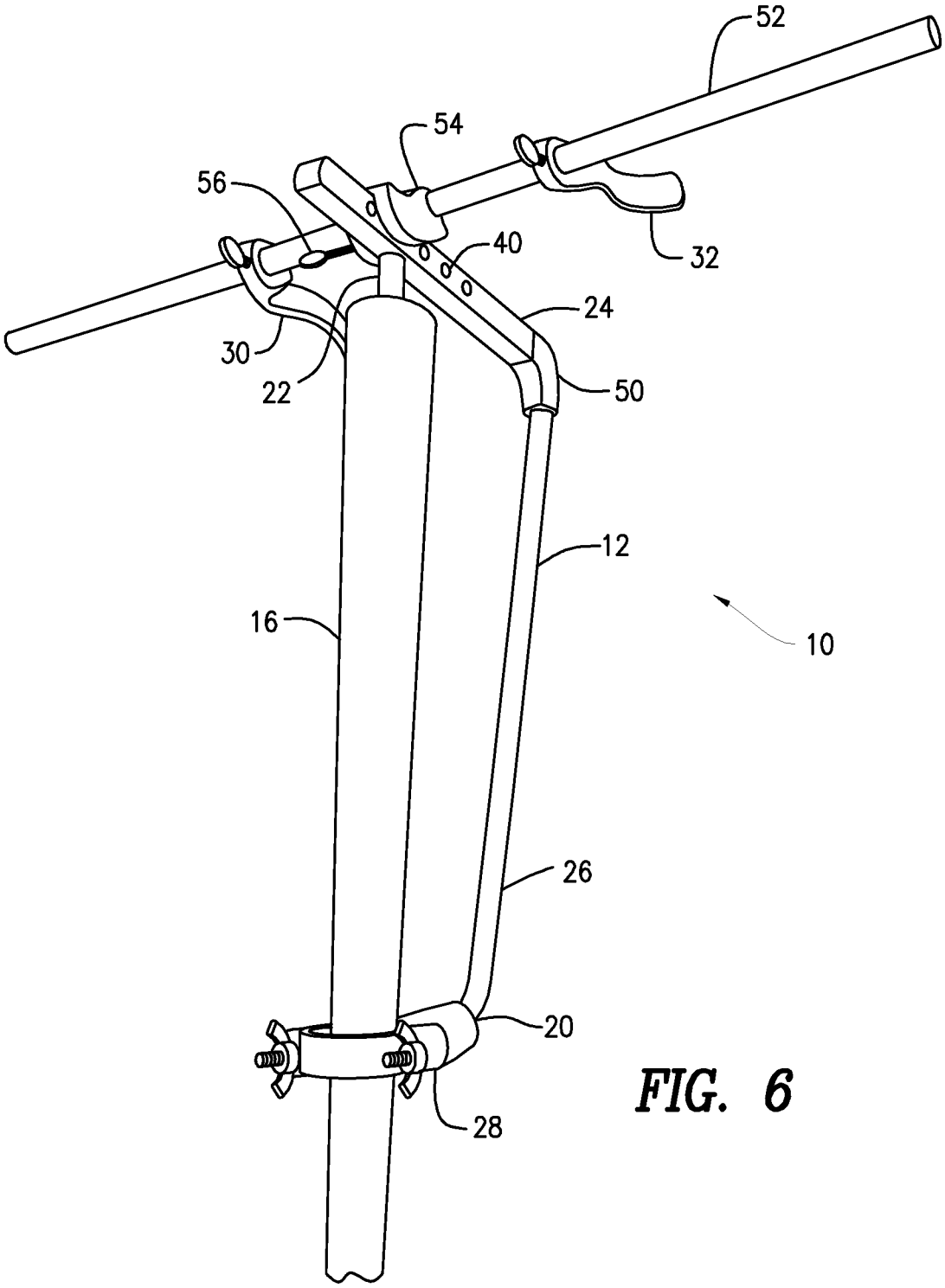
FIG. 6 is side view of the impact training device shown in FIG. 5 attached to a sports device.
Figure 7:
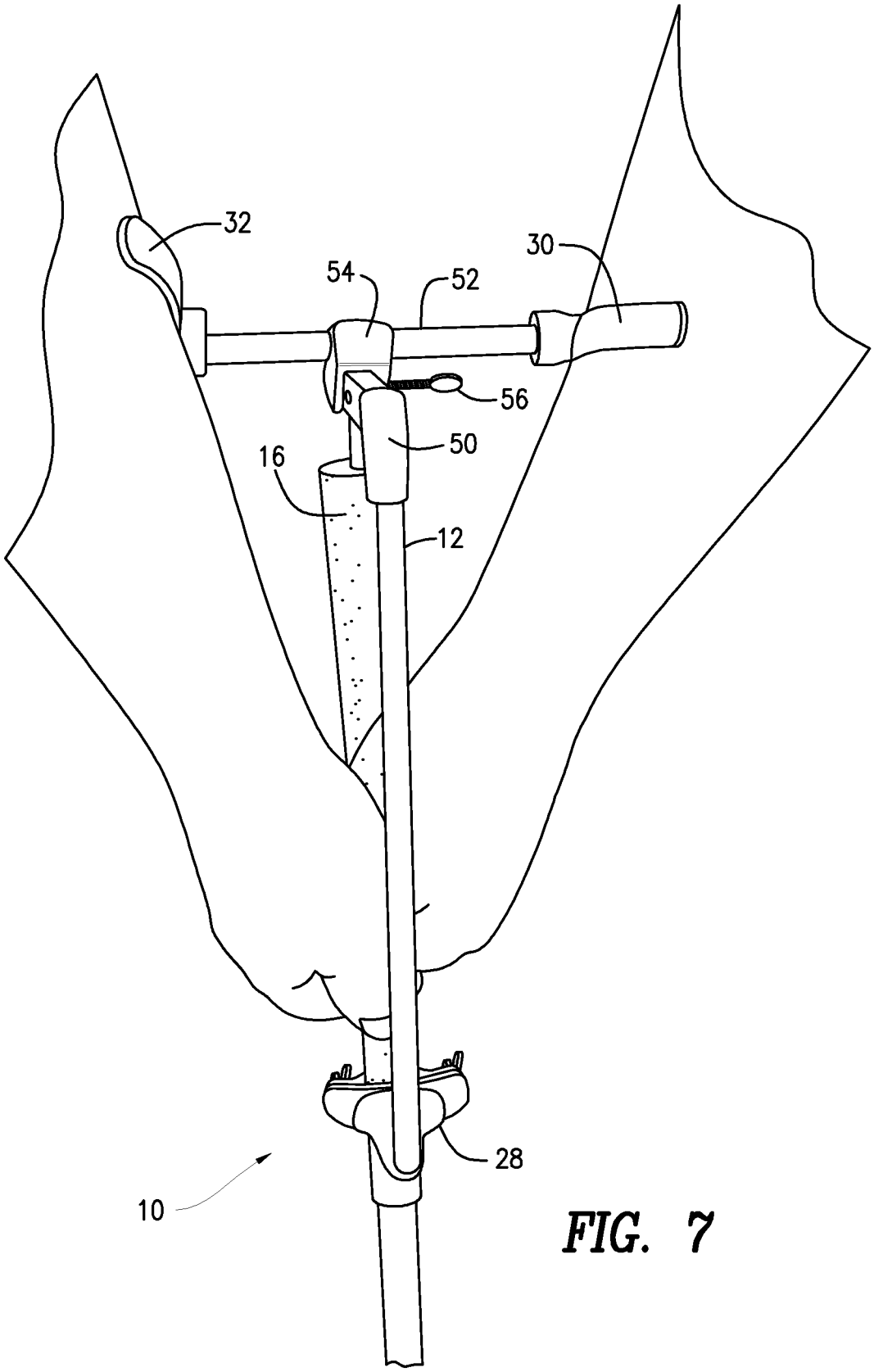
FIG. 7 is a front view of the impact training device shown in FIG. 6 with a user positioned to use the impact training device.

Referring now to FIGS. 6-7, in an exemplary use of the device 10 shown in FIG. 5, the second elongate rod 52 may be coupled to the handle connector 24 in a substantially orthogonal configuration with the handle connector 24 facing away from the user when the user's hands grip the handle 16. The first alignment element 30 and the second alignment element 32 may be rotated to be oriented to face away from the user when the user's hands grip the handle 16, as shown in FIG. 6. In this configuration, the second rod engagement element 54 may be moved toward or away from the user by engaging with a notch 40 along the length of the first portion 24 of the handle connector 24, which in turns moves the second elongate rod 52 toward or away from the user. The longitudinal movability of the second elongate rod 52 relative to the handle connector 24 allows for the user to adjust the spacing of first alignment element 30 and the second alignment element 32 along the length of the second elongate rod 52. For example, as shown in FIG. 6, the user's forearms are shown pressed against the alignment elements and the user's hands are in position for a putting or chipping stroke. In other configurations, as the alignment elements are spaced further apart from each other, the user's wrists may be in contact with the wrist alignment elements. In the example shown in FIG. 6, as the user moves the golf club backward during a putt, the user's lead arm is in contact with the first alignment element 30, and as the user moves the golf club forward, the user's trail arm is in contact with the second alignment element 32 so that the user's forearms and wrists are kept in proper alignment during impact with the golf ball.

Figure 8:
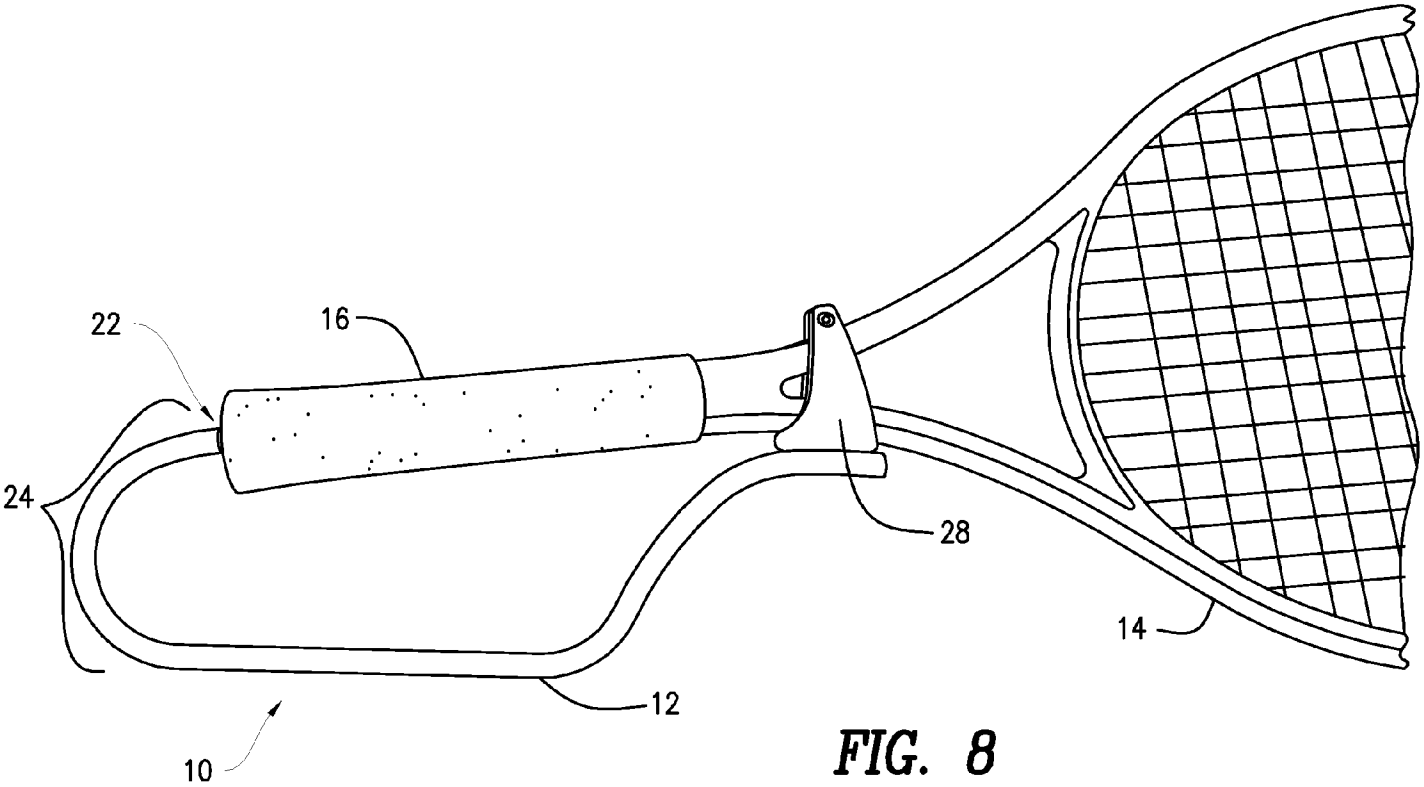
FIG. 8 is side perspective view of another embodiment of an impact training device and generally constructed in accordance with the principles of the present invention.

Referring now to FIG. 8, the sports device 10 discussed above may be permanently or releasably attachable to other sports devices 14, for example, a tennis racquet, baseball bat, hockey stick, lacrosse stick, and the link. In an exemplary configuration, the first elongate rod 12 may be permanently affixed to the handle 16 of a tennis racquet 14 and may be radially displaced from the handle 16. In such a configuration, the first elongate rod 12 applies a force to the user's wrists and our forearm during swing to prevent over-pronation and over flexion during impact with a ball. It is further contemplated that the first elongate rod 12 may be attached to a handle 16 of a golf club without the wrist alignment elements to aide in the proper positioning of the wrists and forearms during a golf swing.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An impact training device, comprising:

an elongate rod defining a length;

a handle engagement element;

a handle connector joining the handle engagement element to the elongate rod;

a wrist guide movably affixable along the length of the elongate rod; and the elongate rod being radially displaced from a handle of a sports device when the handle engagement element is engaged to the handle of the sports device.

2. The device of claim 1, further including a sports device engagement element engageable to the sports device.

3. The device of claim 2, wherein the elongate rod includes a first end and a second end, and wherein the handle connector is coupled at the first end and the sports device engagement element is coupled at the second end.

4. The device of claim 3, wherein the elongate rod, the handle connector, the handle engagement element, and the sports device engagement element define a closed loop with the handle of sports device when the handle engagement element is engaged to the handle of the sports device and the sports device engagement element is engaged to the sports device.

5. The device of claim 3, wherein the handle of the sports device defines a major axis, and wherein the handle engagement element is substantially parallel to the major axis when engaged to the handle of the sports device.

6. The device of claim 3, wherein the handle of the sports device defines a major axis, and wherein the sports device engagement element defines an angle with the major axis less than 90 degrees when engaged to the handle of the sports device.

7. The device of claim 1, further including an alignment element engaged to the elongate rod.

8. The device of claim 7, wherein the alignment element is engaged to the elongate rod at substantially a 90 degree angle.

9. The device of claim 8, wherein the alignment element is movably affixable to the elongate rod.

10. The device of claim 1, wherein the elongate rod includes a plurality of notches, and wherein the wrist guide element is securable with at least one of the plurality of notches.

11. An impact training device, comprising:

a first elongate rod;

a handle engagement element;

a handle connector joining the handle engagement element to the elongate rod, the handle connector defining a length;

the first elongate rod being radially displaced from a handle of a sports device when the handle engagement element is engaged to the handle of the sports device;

a second elongate rod engageable with the handle connector, the second elongate rod being substantially orthogonal to the handle connector when engaged to the first elongate rod, the second elongate rod being movably affixable to a plurality positions along the length of the handle connector; and a first alignment element movably engaged to the second elongate rod.

12. The device of claim 11, wherein the handle connector includes a second elongate rod engagement element.

13. The device of claim 12, wherein the first alignment element and the second alignment are disposed on the second elongate rod on opposite sides of the second elongate rod engagement element.

14. The device of claim 13, wherein the second rod engagement element couples the second elongate rod to the handle connector.

15. The device of claim 14, wherein the handle connector includes a plurality of notches, and wherein the second elongate rod engagement element is releasably affixable to each of the plurality of notches.

16. The device of claim 11, further including a sports device engagement element engageable with the sports device, and wherein the first elongate rod, the handle connector, the handle engagement element, and the sports device engagement element define a closed loop with the handle of sports device when the handle engagement element is engaged to the handle of the sports device and the sports device engagement element is engaged to the sports device.

17. The device of claim 11, wherein the handle of the sports device defines a major axis, and wherein the handle engagement element is substantially parallel to the major axis when engaged to the handle of the sports device.

18. The device of claim 11, further including a second alignment element movably coupled to the second elongate rod.

19. An impact training device, comprising:

an elongate rod defining a length;

a sports device engagement element;

a handle engagement element;

a handle connector joining the handle engagement element to the elongate rod;

the elongate rod being radially displaced from a handle of a sports device when the handle engagement element is engaged to the handle of the sports device;

the elongate rod, the handle connector, the handle engagement element, and the sports device engagement element define a closed loop with the handle of sports device when the handle engagement element is engaged to the handle of the sports device and the sports device engagement element is engaged to the sports device;

a first alignment element movably affixed to the handle connector a second alignment element movably affixed to the elongate rod; and a wrist guide movably affixable along the length of the elongate rod.

* * * * *